US007748870B2

(12) United States Patent
Chang et al.

(10) Patent No.: US 7,748,870 B2
(45) Date of Patent: Jul. 6, 2010

(54) LED LAMP BULB STRUCTURE

(75) Inventors: Kun-Jung Chang, Kaohsiung County (TW); Ching-Yuan Juan, Kaohsiung County (TW); Kuo-Chun Lin, Kaohsiung County (TW); Ching-Huang Juan, Kaohsiung County (TW)

(73) Assignee: Li-Hong Technological Co., Ltd., Kaohsiung County (TW)

( * ) Notice: Subject to any disclaimer, the term of this patent is extended or adjusted under 35 U.S.C. 154(b) by 234 days.

(21) Appl. No.: 12/132,281

(22) Filed: Jun. 3, 2008

(65) Prior Publication Data

US 2009/0296402 A1 Dec. 3, 2009

(51) Int. Cl.
*F21V 29/00* (2006.01)

(52) U.S. Cl. ..... 362/294; 362/373

(58) Field of Classification Search ..... 362/294, 362/547, 264, 345, 373, 580, 126, 218, 800
See application file for complete search history.

(56) References Cited

U.S. PATENT DOCUMENTS 7,494,248 B2 * 2/2009 Li ..... 362/294
7,568,817 B2 * 8/2009 Lee et al. ..... 362/294
7,631,987 B2 * 12/2009 Wei ..... 362/294
2007/0285926 A1 * 12/2007 Maxik ..... 362/294
2009/0141500 A1 * 6/2009 Peng ..... 362/294

* cited by examiner

*Primary Examiner*—Bao Q Truong
(74) *Attorney, Agent, or Firm*—Muncy, Geissler, Olds & Lowe, PLLC

(57) ABSTRACT

A LED lamp bulb structure is disclosed, wherein a lamp controller is installed inside a lamp head and the bottom surface thereof is fixed by an upper cover. At the bottom surface of the upper cover, a heat dispersing fin set, which has at least a heat conducting tube installed therein, and a lower cover are fixed therein. Furthermore, a bulb housing, which has a tray mounted therein, is screwed around the peripheral edge of the lower cover, and at the bottom of the tray, plural LED lamp sets corresponding to plural heat conducting tubes are outwardly extended. Therefore, the heat produced by the LED lamp set can have a heat exchange through plural heat conducting tubes and heat dispersing fin set for achieving a better heat dispersing efficiency and for more effectively dispersing the heat.

12 Claims, 7 Drawing Sheets

LED LAMP BULB STRUCTURE

FIELD OF THE INVENTION

The present invention is related to a LED lamp bulb structure, and more particularly to a LED lamp bulb structure which can disperse heat more efficiently and more rapidly.

BACKGROUND OF THE INVENTION

Owing to the very little energy consumption during operation, LED bulbs have already in place of conventional incandescent lamps in many products, such as decoration lamps, advertisement signs or traffic signs.

However, although the LED lamp 10 can illuminate with very little power supply, the temperature still will become higher when illumination, so that for facilitating replacement, usually, a protection shell 11 (as shown in FIG. 11) is mounted around the LED lamp. Although the protection shell 11 can be held by the consumer as replacing the LED lamp 10, it also encapsulate the high temperature therein and cause a worse heat dispersing, thereby the LED lamp is easily damaged and the life time thereof is short.

Furthermore, another kind of structure is developed, wherein a LED lamp 20 is fixed under a heat conducting plate 22, and on the other side of the conducting plate 22, heat sinks 21 spaced at intervals are combined therewith (as shown in FIG. 2). When operation, the heat produced by the LED lamp 20 can be absorbed by the heat conducting plate 22 and then transmitted to heat sinks 21 for dispersing. However, after heating a period of time, a bake effect might appear to all heat sinks 21, so that the contact conduction of the heat sinks 21 are easily saturated, thereby increasing the difficulty to disperse the heat. Therefore, the life time of LED lamp 20 also might be reduced, so that the heat dispersing is still insufficient.

SUMMARY OF THE INVENTION

The object of the present invention is to provide a heat dispersing structure in which plural heat conducting tubes and heat sinks are used to perform heat exchange and separate the heat for achieving a better heat dispersing efficiency and for more effectively dispersing the heat.

For solving the problem described above, the present invention provides a LED lamp bulb structure, wherein a lamp controller is installed inside a lamp head and the bottom surface thereof is fixed by an upper cover. At the bottom surface of the upper cover, a heat dispersing fin set, which has at least one heat conducting tube installed therein, and a lower cover are fixed therein. Furthermore, a bulb housing, which has a tray mounted therein, is screwed around the peripheral edge of the cover, and at the bottom of the tray, plural LED lamp sets corresponding to plural heat conducting tubes are outwardly extended.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
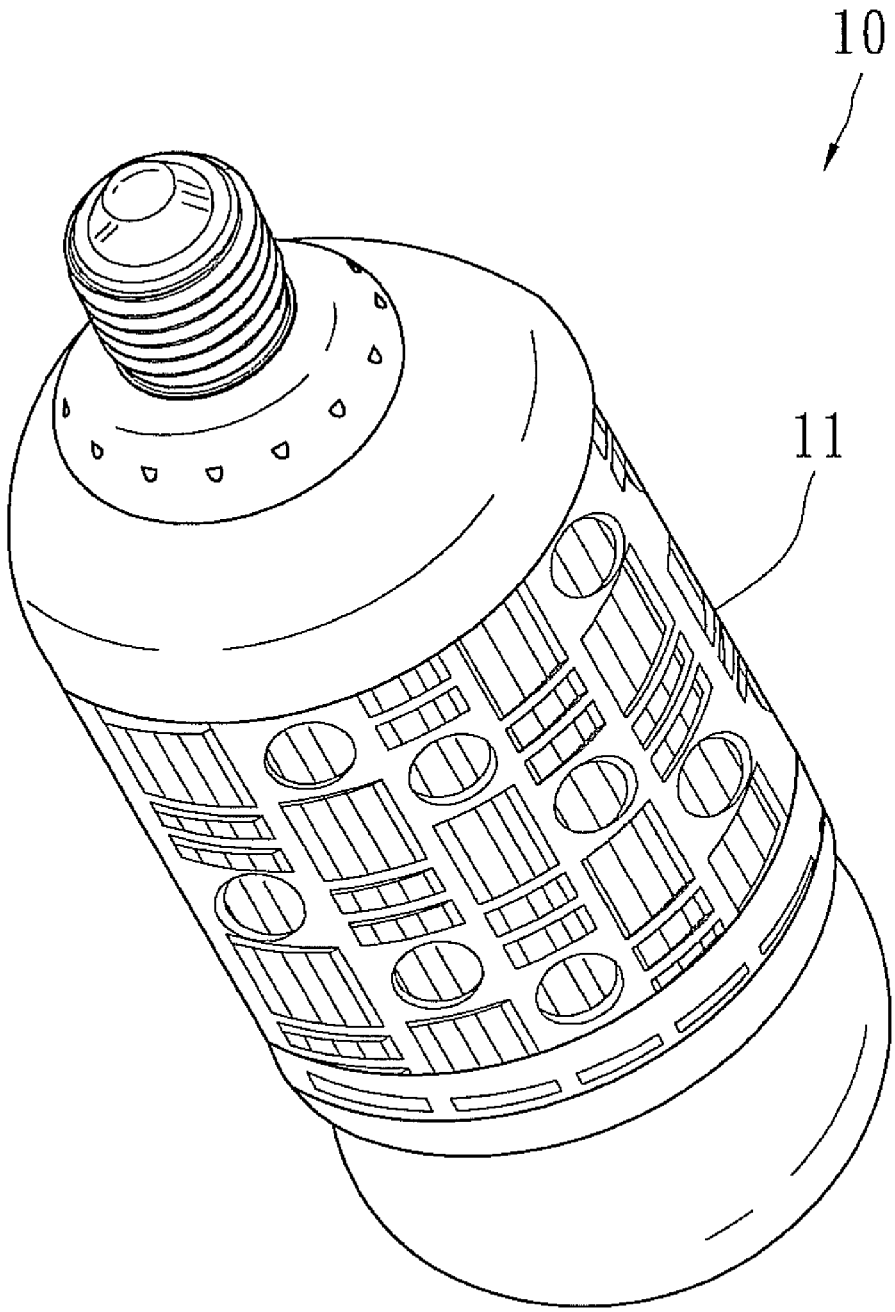
Fig. 1 PRIOR ART
FIG. 1 is a three-dimensional drawing showing a conventional LED lamp.
Figure 2:
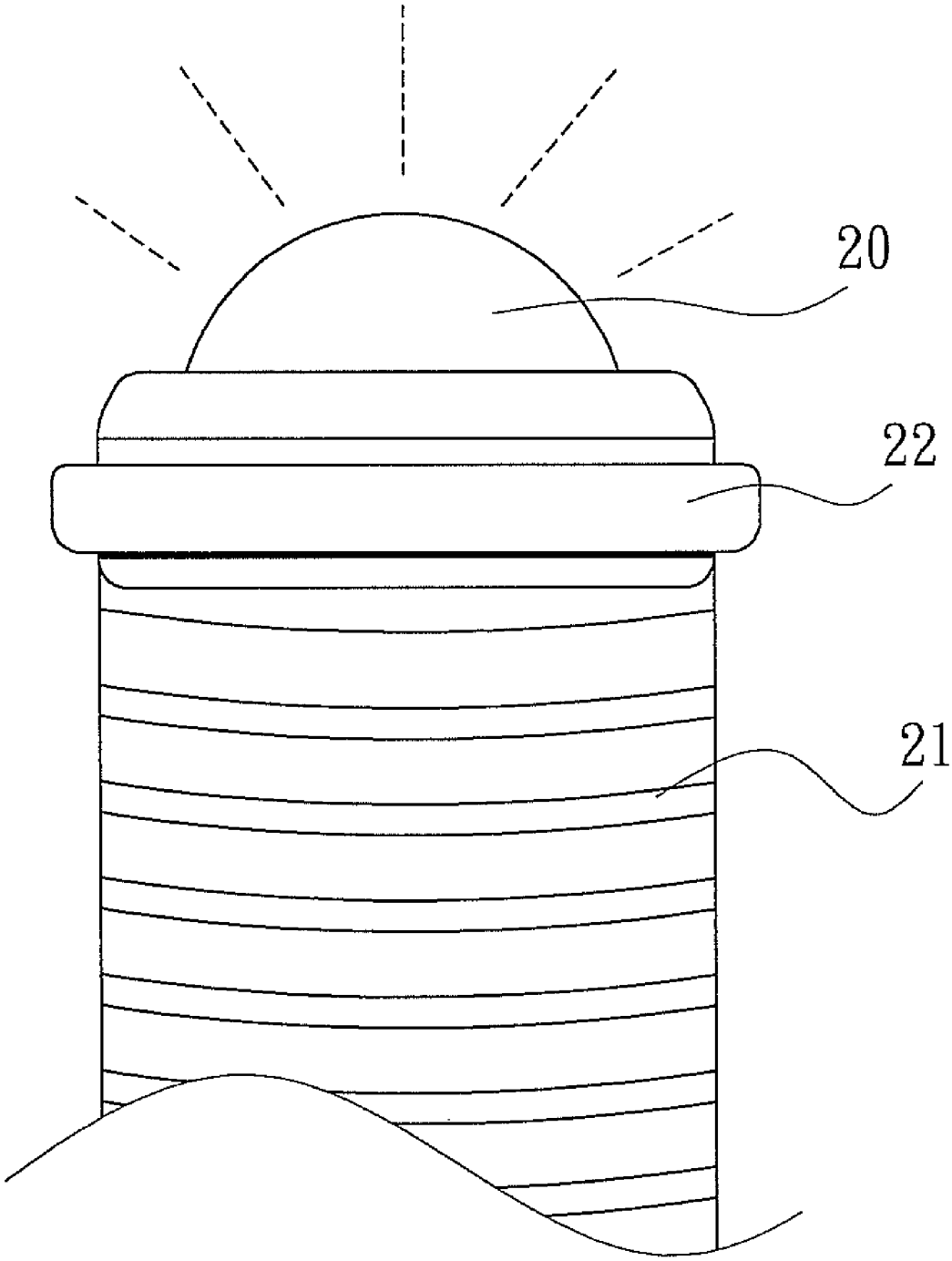
Fig. 2 PRIOR ART
FIG. 2 is a three-dimensional drawing showing another conventional LED lamp.
Figure 3:
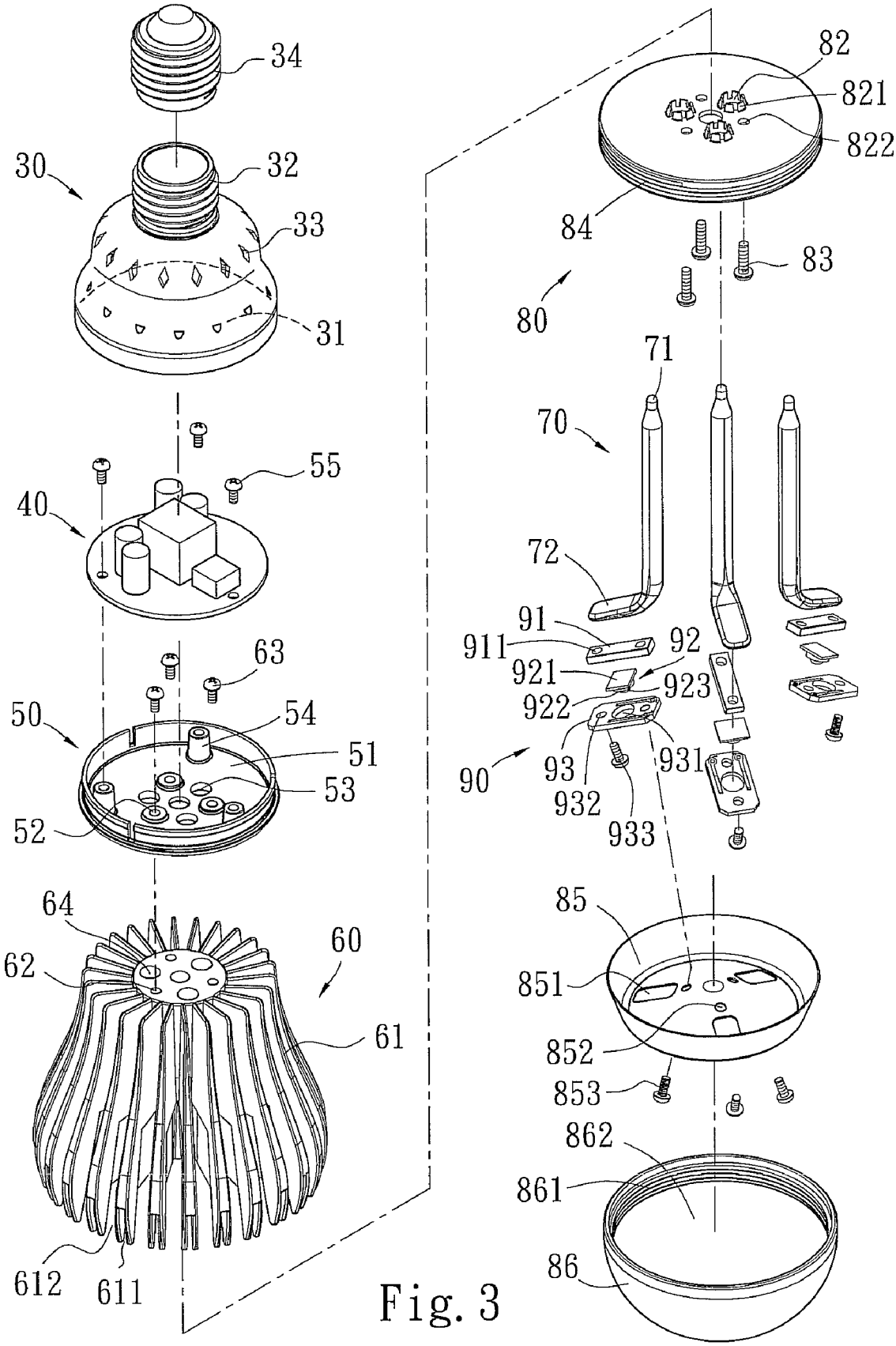
FIG. 3 is a three-dimensional decomposition drawing of the present invention.
Figure 4:
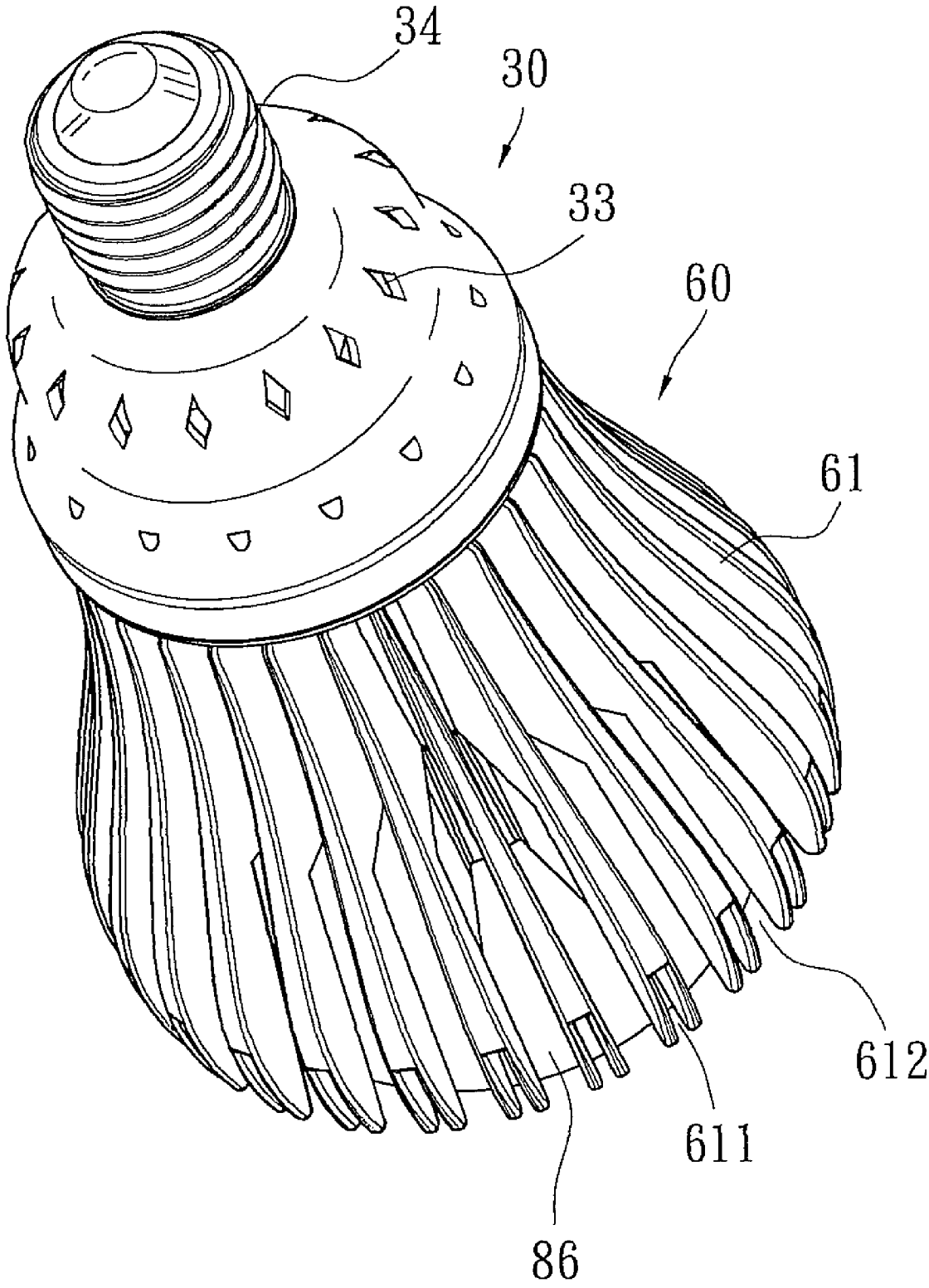
FIG. 4 is a three-dimensional drawing showing the appearance of the present invention.
Figure 6A:
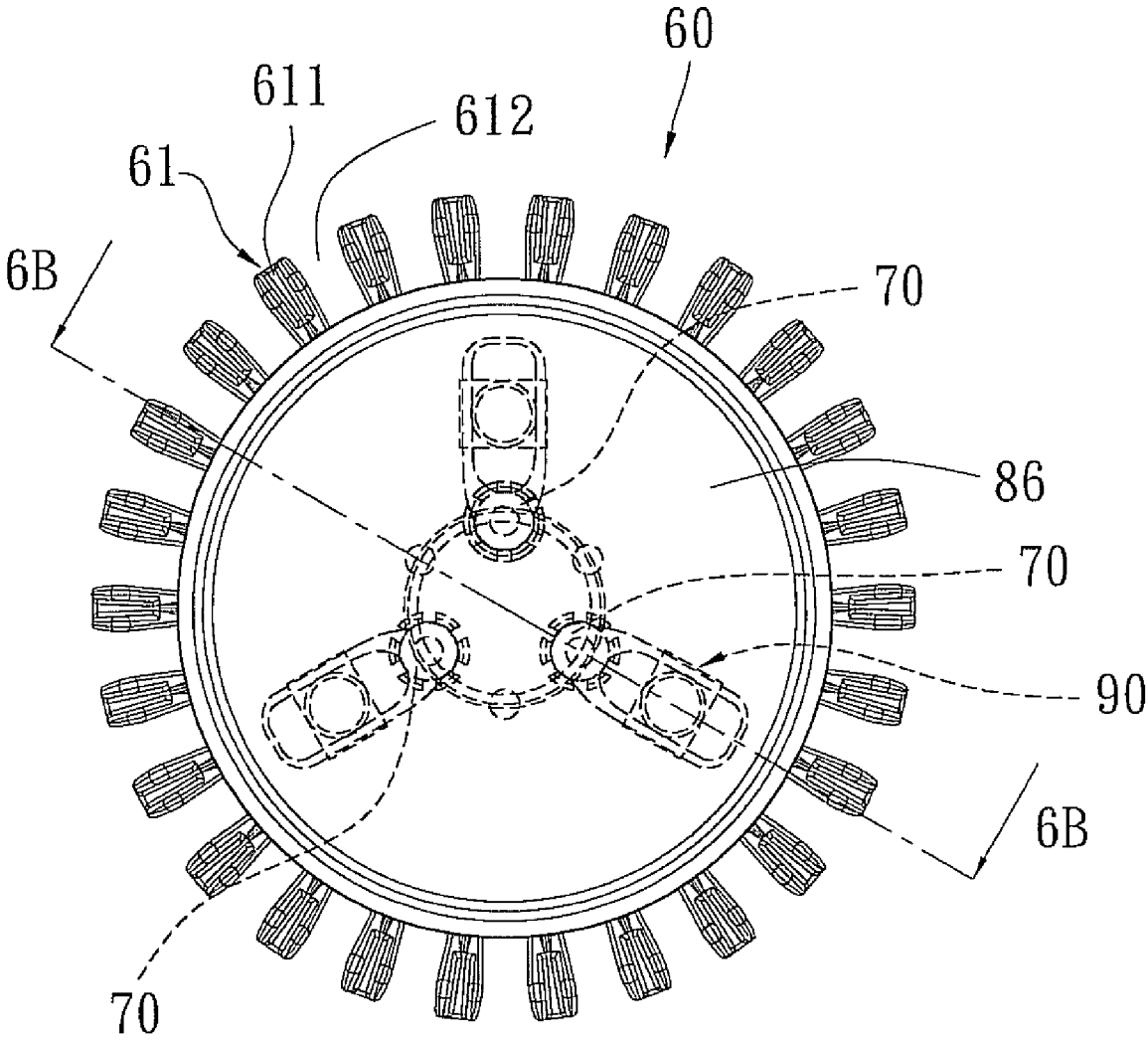
FIG. 6A is an upward view showing the present invention.
Figure 6B:
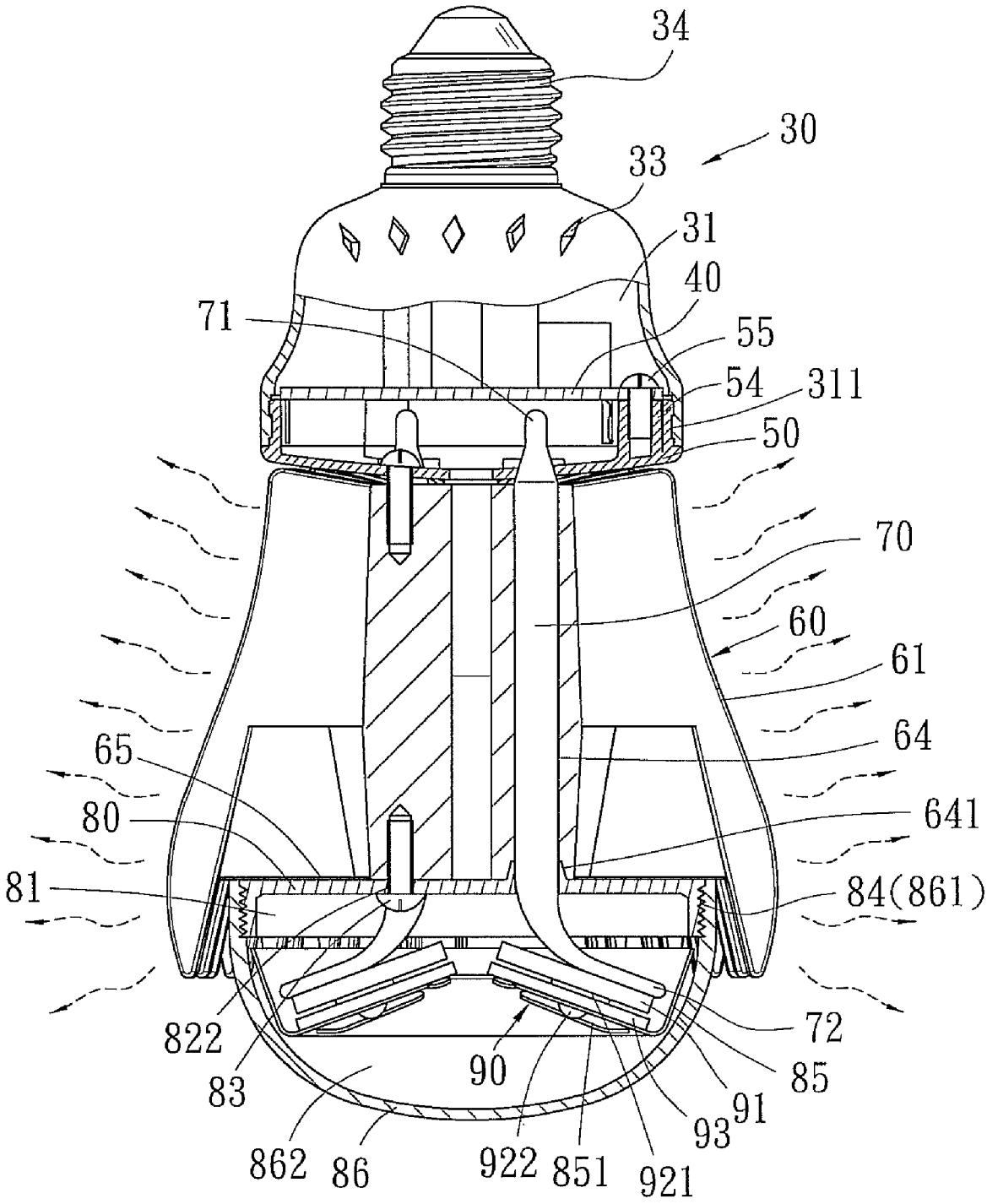
FIG. 6B is a sectional view of 6B-6B in FIG. 6A showing heat dispersing.

Please refer to FIG. 3, FIG. 4 and FIG. 6B. The present invention includes a lamp head 30, a lamp controller 40, an upper cover 50, heat dispersing fin set 60, plural heat conducting tubes 70, a lower cover 80, and plural LED lamp sets 90, wherein:

The lamp head 30 has an inner accommodating space 31 and an engaging space 311 at the bottom thereof for fixedly mounting the lamp controller 40 and the upper cover 50, a screw portion 32 located at the top portion thereof for electrically connecting to a lamp base 34, and plural ventilating holes 33 mounted at an outer edge near the screw portion 32.

The lamp controller 40 is fixed in the inner accommodating space 31 of the lamp head 30.

The upper cover 50 is installed in the engaging space 311 of the lamp head 30 and is rejected to the bottom surface of the lamp controller 40, and the upper cover 50 has an inwardly indented chamber 51, which has at least a first through hole 52 and perforation 53 respectively mounted at the center portion of the chamber 51, and has plural linking bolts 54 mounted at the peripheral edge of the cover 50 for cooperating with locking elements 55 to lock and position the lamp controller 40.

The heat dispersing fin set 60 is a heat dispersing integration, whose upper portion is narrower than the lower portion and which is composed of plural heat dispersing fins 61, wherein through at least a locking hole 62 which is corresponding to the perforation 53 of the upper cover 50 and using fixing element 63, such as screw, the heat dispersing fin set 60 can be fixed to the bottom surface of the cover 50. Penetrating holes 64 corresponding to plural first through holes 52 are mounted between plural locking holes 62, and a burying hole 641 is respectively mounted at the end of each penetrating hole 64. Furthermore, the ends of plural heat dispersing fins 61 are respectively formed to have a sharp portion 611 for reducing the weight of the heat dispersing fin set 60 thereof and also for providing a pleasing appearance. And, intervals 612 are kept between heat dispersing fins 61 for facilitating heat dispersing. In addition, the heat dispersing fin set 60 has an inwardly indented space 65 at the bottom portion thereof for receiving and sleeving on the lower cover 80.

Plural heat conducting tubes 70 are penetrated through second through holes 82 of the lower cover 8, which is located under the heat dispersing fin set 60, and plural penetrating holes 64. The number of heat conducting tube 70 can be more than one, as shown, in a preferred embodiment, there are three tubes 70. The heat conducting tube 70 can be solid or hollow. One end of the heat conducting tube 70 is formed to be a protruded bolt portion 71 for passing through the first through hole 52 of the upper cover 50 and electrically connecting to the lamp controller 40, and the other end is bent to form an outwardly inclined board 72 which can condense the light. Besides, the bottom portion of the outwardly inclined board 72 is used to fix with LED lamp set 90.

The lower cover 80 is fixedly mounted in the inwardly indented space 65 at the bottom of the heat dispersing fin set 60. The lower cover 80 has an inwardly indented chamber 81 in the inner portion thereof and has the second through holes 82 mounted thereon corresponding to the penetrating holes 64 of the heat dispersing fin set 60. The other end of each second through hole 82 is extended to have protruded embedding bodies 821 for engaging in the burying hole 641 at the end of the penetrating hole 64. Between the second through holes 82, a locking hole 822 is formed for cooperating with locking element 83, such as screw, so that the lower cover 80 can be fixed at the bottom of the heat dispersing fin set 60. Furthermore, an outer screwing portion 84 is formed at the outer peripheral of the lower cover 80 for screwing with a inner screwing portion 861 of a bulb housing 86, in which the bulb housing 86 has an upwardly opened chamber 862 for installing a tray 85, and the tray 85 is an upwardly opened disc and has slot holes 851 mounted at the bottom near the peripheral edge corresponding to plural heat conducting tubes 70. Besides, in the center of each slot hole 851, through holes 852 corresponding to locking hole 822 of the lower cover 80 are mounted thereon for screwing with fixing element 853 such as a screw.

The LED lamp set 90 is fixedly mounted at the bottom portions of the outwardly inclined boards 72 of plural heat conducting tubes 70 and is protruded out of the bottom surface of the try 85. The LED lamp set 90 at least includes a heat conducting block 91, a LED lamp 92, and a substrate 93, wherein the heat conducting block 91 is pasted at the bottom of the outwardly inclined board 72, the LED lamp 92 has a plate 921 located at one side thereof and, at the other side, a light emitting diode 922 with a protection frame 923 surrounding thereof, the substrate 93 is a printed circuit board with circuitry having through hole 931 for embedding LED lamp 92, serial circuit (not shown) located at one side for serially connecting with the LED lamp 92 so as to increase brightness, and plural perforations 932 mounted thereon for cooperating with the fixing element 933, which penetrates into the perforations 932, so as to lock the substrate 93 on the heat conducting block 91, and the heat conducting block 91 is a metal block with thickness and high heat conductivity for serving as a heat dispersing medium, pasted at one side of the plate 921 of the LED lamp 92 for dispersing the produced heat, and has plural locking holes 911 mounted thereon for cooperating with the fixing elements 933 so as to connect the heat conducting block 91 to the substrate 93.

Figure 5:
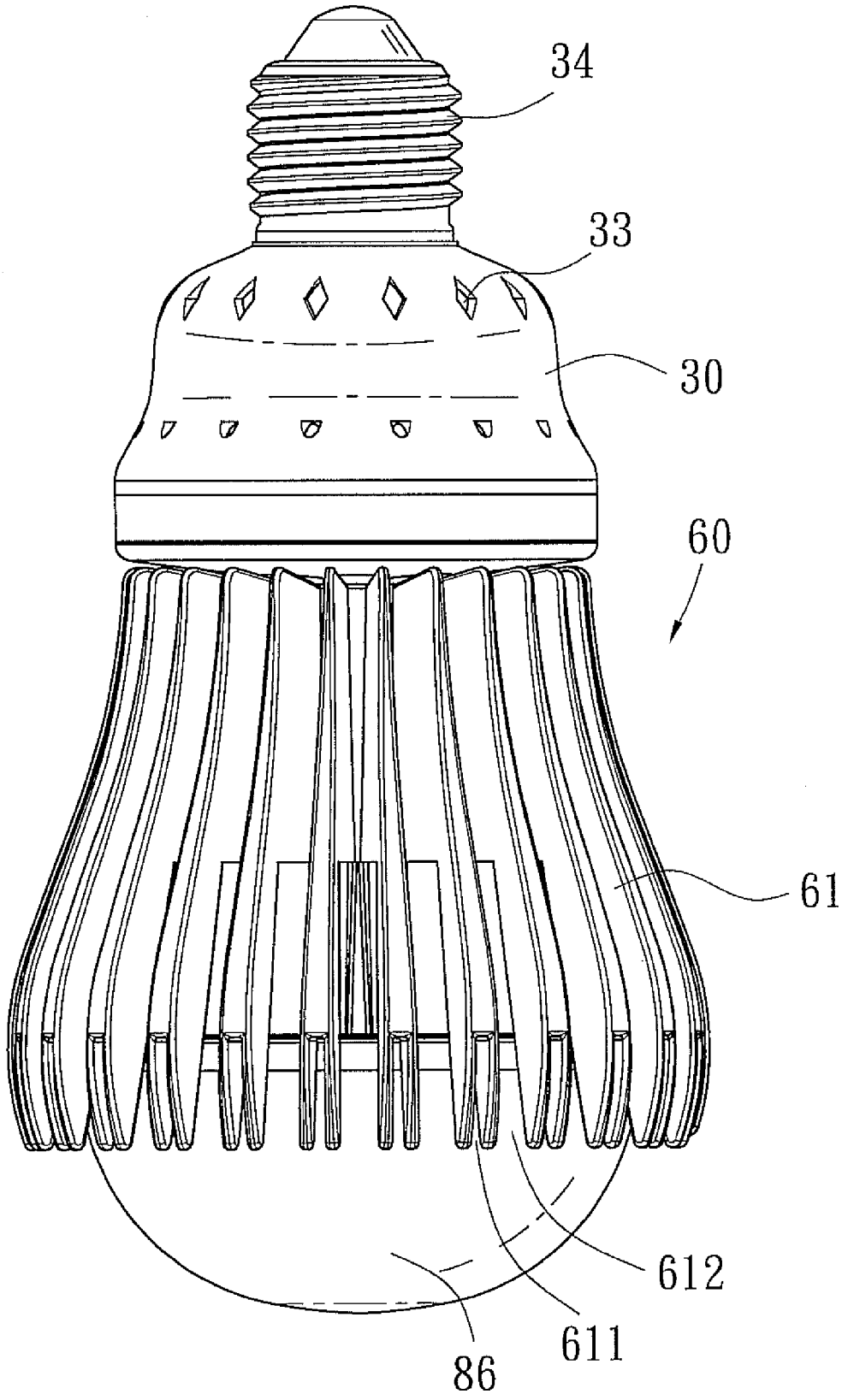
FIG. 5 is a front view showing the present invention.

Please refer to FIG. 5, FIG. 6A and FIG. 6B. When assembling, the lamp controller 40 is installed inside the lamp head 30 and the bottom surface thereof is fixed by the upper cover 50. At the bottom surface of the upper cover 50, a heat dispersing fin set 60, which has at least a heat conducting tube 70 installed therein, and a lower cover 80 are fixed. A bulb housing 86, which has a tray 85 mounted therein, is screwed around the peripheral edge of the lower cover 80. At the bottom of the tray 85, plural LED lamp sets 90 corresponding to plural heat conducting tubes 70 are outwardly extended. In view of the structure described above, when operating the LED lamp set 90 which is mounted at the bottoms of the outwardly inclined boards 72 at one ends of plural heat conducting tubes 70, through the heat exchange performed by plural heat conducting tubes 70 and heat dispersing fin set 60, the produced high temperature and heat can be conducted by plural heat conducting tubes 70 to the heat dispersing fin set 60 and dispersed by each heat dispersing fin 61, so as to achieve a more efficient heat dispersing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A LED lamp bulb structure, comprising:

a lamp head, having engaging space located at the bottom portion thereof;

a lamp controller, fixed in the lamp head;

an upper cover; disposed in the engaging space of the lamp head and rejected to the bottom surface of the lamp controller, having an inwardly indented chamber with plural first through holes;

a heat dispersing fin set, fixed at the bottom surface of the upper cover and having an inwardly indented space at the bottom thereof and plural penetrating holes corresponding to plural first through holes mounted at the central portion thereof, wherein plural heat dispersing fin sets are assembled to form a heat dispersing integration;

a lower cover, fixedly mounted in the inwardly indented space at the bottom of the heat dispersing fin set, and having an inwardly indented chamber in the inner portion thereof and plural second through holes mounted at the central portion thereof corresponding to plural first through holes for screwing with a bulb housing, which accommodates a tray therein;

plural heat conducting tubes, penetrated through second through holes of the lower cover, which is located under the heat dispersing fin set, and plural penetrating holes, wherein one end of the heat conducting tube is formed to be a protruded bolt portion for passing through the first through hole of the upper cover and electrically connecting to the lamp controller, and the other end is bent to form an outwardly inclined board; and plural LED lamp sets, fixedly at the bottom portions of the outwardly inclined boards of plural heat conducting tubes and protruded out of the bottom surface of the tray.

2. The LED lamp bulb structure as claimed in claim 1, wherein the number of the first through hole mounted at the inwardly indented chamber of the upper cover is implemented as at least one.

3. The LED lamp bulb structure as claimed in claim 1, wherein plural linking bolts are mounted at the peripheral edge of the upper cover for locking and positioning the lamp controller.

4. The LED lamp bulb structure as claimed in claim 1, wherein each penetrating hole has a burying hole mounted at the end thereof.

5. The LED lamp bulb structure as claimed in claim 1, wherein the lower cover has second through holes mounted thereon and protruded embedding bodies extended therefrom.

6. The LED lamp bulb structure as claimed in claim 1, wherein the ends of plural heat dispersing fins are respectively formed to have a sharp portion so as to provide an interval between each heat dispersing fin.

7. The LED lamp bulb structure as claimed in claim 1, wherein the number of the heat conducting tube is at least one.

8. The LED lamp bulb structure as claimed in claim 1, wherein the bulb housing has an upwardly opened chamber for installing a tray.

9. The LED lamp bulb structure as claimed in claim 1, wherein the tray is an upwardly opened disc and has slot holes corresponding to plural heat conducting tubes mounted at the bottom near the peripheral edge.

10. The LED lamp bulb structure as claimed in claim 1, wherein the LED lamp set comprises a heat conducting block pasted at the bottom of the outwardly inclined board, a LED lamp located on the bottom of the heat conducting block, and a substrate locked with the heat conducting block.

11. The LED lamp bulb structure as claimed in claim 10, wherein the LED lamp has a plate located at one side thereof and, at the other side, a light emitting diode with a protection frame surrounding thereof.

12. The LED lamp bulb structure as claimed in claim 10, wherein the substrate is a printed circuit board with circuitry having plural through holes for embedding the LED lamp, and serial circuit located at one side for serially connecting with the LED lamp.

* * * * *